US008171988B2

(12) United States Patent
Hallundbaek et al.

(10) Patent No.: US 8,171,988 B2
(45) Date of Patent: May 8, 2012

(54) STROKER TOOL

(75) Inventors: Jørgen Hallundbaek, Graested (DK); Rasmus Sommer, Valby (DK)

(73) Assignee: Weltec A/S, Allerod (DK)

( * ) Notice: Subject to any disclaimer, the term of this patent is extended or adjusted under 35 U.S.C. 154(b) by 219 days.

(21) Appl. No.: 12/596,232

(22) PCT Filed: Apr. 24, 2008

(86) PCT No.: PCT/DK2008/000151

§ 371 (c)(1),
(2), (4) Date: Dec. 15, 2009

(87) PCT Pub. No.: WO2008/128543

PCT Pub. Date: Oct. 30, 2008

(65) Prior Publication Data

US 2010/0126710 A1 May 27, 2010

(30) Foreign Application Priority Data

Apr. 24, 2007 (DK) ..... 2007 00598

(51) Int. Cl.
*E21B 23/04* (2006.01)

(52) U.S. Cl. ..... 166/66.4; 166/178

(58) Field of Classification Search ..... 166/66.4, 166/178

See application file for complete search history.

(56) References Cited

U.S. PATENT DOCUMENTS

| | | | | |
|---|---|---|---|---|
| 1,612,779 | A | 12/1926 | Mercer | |
| 2,944,520 | A | 7/1960 | Swanson | |
| 3,131,606 | A | 5/1964 | Oelke | |
| 3,138,214 | A | 6/1964 | Bridwell | |
| 6,712,158 | B2 | 3/2004 | Moore | |
| 7,896,090 | B2 * | 3/2011 | Storey et al. | 166/387 |

FOREIGN PATENT DOCUMENTS

WO WO 2006/107215 10/2006

OTHER PUBLICATIONS

International Preliminary Report on Patentability dated Oct. 27, 2009.

* cited by examiner

*Primary Examiner* — William P Neuder
(74) *Attorney, Agent, or Firm* — Cozen O'Connor

(57) ABSTRACT

A stroker tool for providing an axial force in an axial direction of a downhole tool. The stroker tool has a pump, a driving unit for driving the pump, and an axial force generator. The generator has an elongated piston housing having a first and a second end, and a piston provided on a shaft, and the shaft penetrates the housing for transmitting the axial force to another tool. The piston is provided in the piston housing so that the shaft penetrates the piston and each end of the piston housing and divides the housing into a first and a second chamber, and the first and the second chamber are each fluidly connected to the pump via at least one duct so that the pump can pump fluid into one chamber by sucking fluid from the other chamber for moving the piston within the housing, and thereby moving the shaft back and forth.

14 Claims, 4 Drawing Sheets

STROKER TOOL

PRIORITY CLAIM

This is a U.S. national stage of application No. PCT/DK2008/000151, filed on Apr. 24, 2008. Priority is claimed on the following application: Denmark Application No.: PA 200700598, Filed on Apr. 24, 2007, the content of which is incorporated here by reference.

TECHNICAL FIELD

The present invention relates to a stroker tool having a piston driven within a piston housing by a pump, which again is driven by a driving unit for providing an axial force.

BACKGROUND

A stroker tool is used for providing a force in the axial direction of the tool downhole.

The stroker may be used for expanding a liner or cladding within a casing in order to seal a leak in the casing. The stroker may also be used for penetrating the formation or an obstacle downhole.

Known stroker tools comprise a piston pump positioned within the stroker in order to provide the axial force. The fluid used in the tool is often the mud surrounding the tool, a drawback of this being that the piston inside the tool may get stuck due to the dirt in the fluid.

DESCRIPTION OF THE INVENTION

An aspect of the present invention is, at least partly, to overcome the disadvantages of the stroker tool mentioned above, and to provide an improved stroker tool providing the same, or even greater, axial force as known stroker tools, and a stroker tool where the risk of the piston getting stuck during use is decreased, if not eliminated.

This aspect and the advantages becoming evident from the description below are obtained by a stroker tool for providing an axial force in an axial direction of a downhole tool, comprising:

- a pump,
- a driving unit for driving the pump, and
- an axial force generator comprising:
  - an elongated piston housing having a first and a second end, and
  - a piston provided on a shaft, the shaft penetrating the housing for transmitting the axial force to another tool, wherein the piston is provided in the piston housing so that the shaft penetrates the piston and each end of the piston housing and divides the housing into a first and a second chamber, and wherein the first and the second chamber are each fluidly connected to the pump via at least one duct so that the pump can pump fluid into one chamber by sucking fluid from the other chamber for moving the piston within the housing and thereby moving the shaft back and forth.

By having a pump for pumping fluid into one chamber and at the same time sucking fluid from the other chamber for moving the piston, the piston is moved substantially faster than in the known solutions of prior art, since these prior art solutions only let pressurised fluid in on one side of the piston, and do not simultaneously suck fluid out on the other side.

Furthermore, the fact that the stroker tool has a pump for pumping fluid into one chamber and at the same time sucking fluid from the other chamber for moving the piston makes it possible for the pumping system of the stroker tool to be a closed system recirculating the same fluid in order to move the piston. Thus, the choice of fluid can be an optimum pumping fluid which does not corrode the inner surface of the chamber, the ducts, and the inside of the pump. In known tools, the piston is moved using the oil mud surrounding the tool, as a result of which the piston may get stuck due to the dirt in the fluid. Moreover, the chemicals in the oil mud have corrosive properties, which may cause severe damage to the tool.

In one embodiment, the housing may comprise a tube closed in each end by a ring within the tube, the rings having sealing means for providing a sealing connection to the shaft.

In another embodiment, the tube may have a plurality of ducts running from the first chamber to the pump and the same number of ducts running from the second chamber to the pump.

Furthermore, the tube may comprise two tubes, namely an inner tube within an outer tube, and the outside of the inner tuber may have grooves which, when placed within the outer tube, constitute the ducts.

In addition, the inner tube may comprise a wall that is substantially thinner than a wall of the outer tube.

Also, the piston may be provided with sealing means for making a sealing connection between the piston and an inside of the housing.

In another embodiment, the stroker tool may comprise a plurality of force generators.

In yet another embodiment, the plurality of force generators may be provided so that the tube comprises several rings dividing the tube into a number of piston housings where each housing is penetrated by the shaft on which, in each piston housing, a piston is provided and where a duct runs from each first and second chamber in each piston housing to the pump.

In addition, the duct connecting the first chamber and the pump may be connected to the first chamber at the end of the chamber closest to the pump, and the duct connecting the second chamber and the pump may be connected to the second chamber at the rearmost end of the chamber in relation to the pump.

Furthermore, the pump may be a high pressure pump, such as a piston pump, a recirculation pump, a centrifugal pump, a jet pump, or the like pump.

The driving unit may be a motor, such as an electrical motor.

Finally, the invention also relates to a downhole system, comprising a stroker tool in accordance with the above and a tool, such as an expansion tool, a packer, a perforation tool, a release device, or the like, using the axial force of the stroker tool.

BRIEF DESCRIPTION OF THE DRAWINGS

The invention is explained in detail below with reference to the drawings, in which.

The drawings are merely schematic and shown for an illustrative purpose.

DETAILED DESCRIPTION OF THE INVENTION

Figure 1:
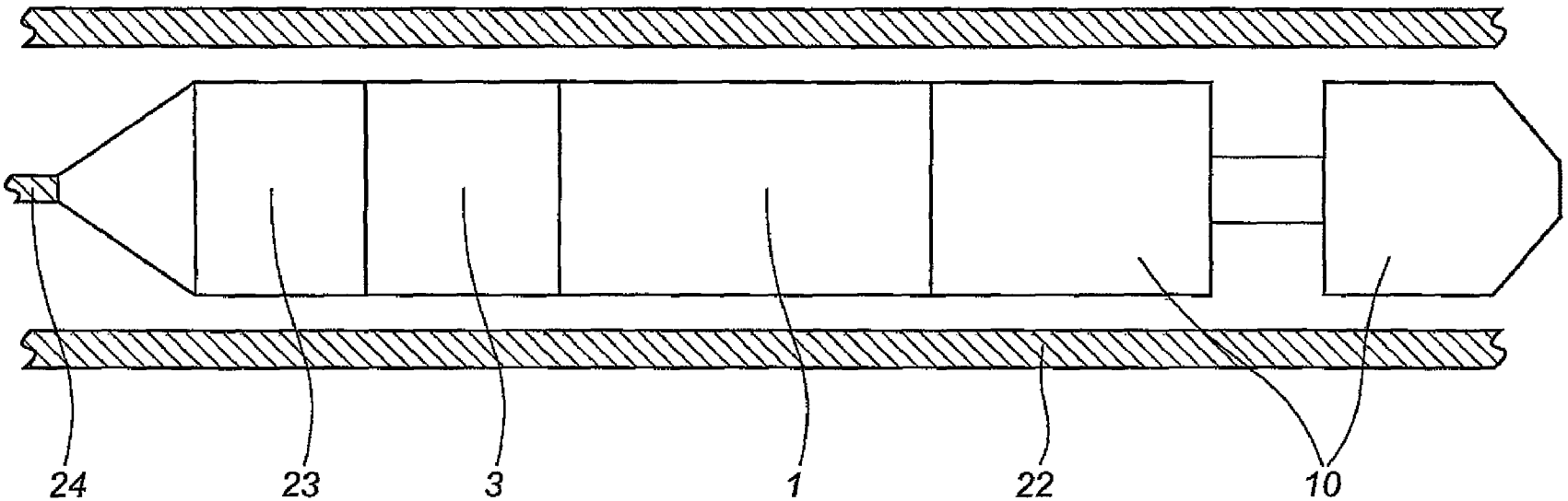
FIG. 1 shows a stroker tool connected to an expansion tool.

In FIG. 1, a stroker tool 1 is shown connected to a driving unit 3, such as an electrical motor, and controlled by a control unit 23. The stroker tool 1 is submerged into a casing 22 downhole via a wireline 24 through which the motor 3 is powered. At the other end of the stroker tool 1, a downhole tool 10 is connected which uses the axial force P generated by the stroker tool 1. In this embodiment, the downhole tool 10 is an expansion tool having a mandrel.

Figure 2:
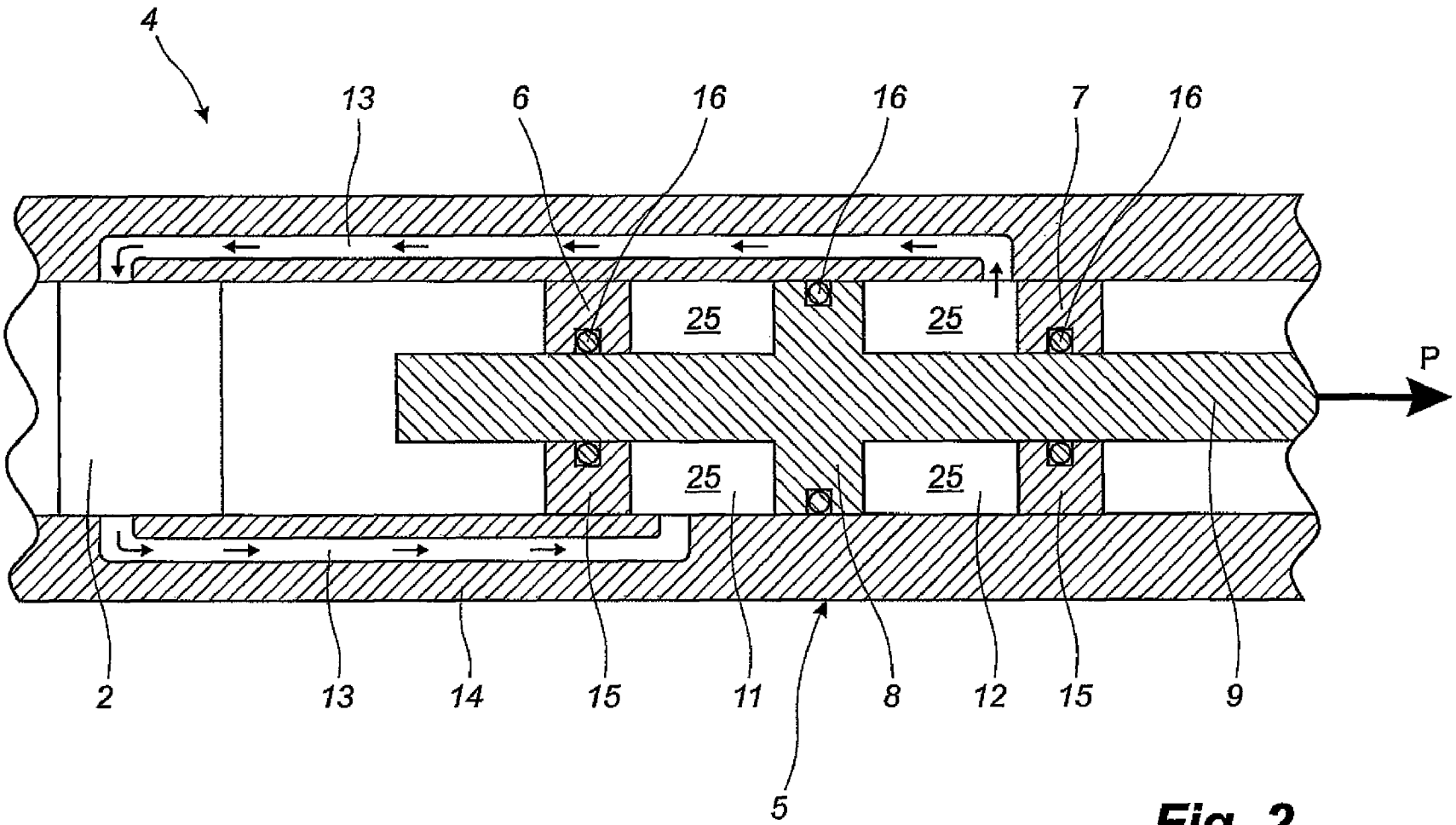
FIG. 2 shows the inside of a stroker tool.

The stroker tool 1 further comprises a force generator 4. The force generator 4 is shown in FIG. 2. The force generator 4 comprises a piston housing 5 which is penetrated by a shaft 9. A piston 8 is provided around the shaft 9 so that the shaft 9 may run back and forth within the housing 5 for providing the axial force P. The piston 8 is provided with a sealing means 16 in order to provide a sealing connection between the inside of the piston housing 5 and the outside of the piston 8.

The piston housing 5 comprises a tube 14 which is closed by two rings 15 for defining the piston housing 5. The rings 15 have a sealing means 16, such as an O-ring, in order to provide a sealing connection between the rings 15 and the shaft 9. In this way, the piston housing 5 is divided into two chambers, namely a first 11 and a second chamber 12. Each chamber is fluidly connected to a pump via ducts 13.

The stroker tool 1 is driven by the motor 3 which drives the pump 2. In FIG. 2, the pump 2 pumps fluid 25 into the first chamber 11 by sucking a corresponding amount of fluid 25 from the second chamber 12; the movement of the fluid being indicated by arrows. Thus, the piston 8 and, consequently, the shaft 9 are driven forward and away from the pump 2 providing an axial force P forward.

When the first fluid chamber 11 is substantially filled and the piston 8 is in its rearmost position in relation to the pump 2, the pump 2 shifts its pumping direction and pumps fluid 25 from the first chamber 11 into the second chamber 12. Consequently, the piston 8 is forced backwards towards the pump 2 in the opposite direction of the arrow P. Thus, the fluid 25 is pumped in an opposite direction than the one indicated by the arrows in FIG. 2. In this way, the piston 8 and, consequently, the shaft 9 are forced back and forth and provide the axial force P.

As can be seen in FIG. 2, the first chamber 11 is provided with a duct 13 at the end closest to the pump 2, and the second chamber 12 is provided with a duct 13 at the rearmost end seen in relation to the pump 2. In this way, fluid 25 can be sucked or pumped into each chamber until the piston 8 almost abuts the ring 15 of the housing 5.

The force generator 4 is thus a closed system, meaning that the same fluid is recirculated being pumped back and forth in the housing in order to move the piston back and forth. Due to this, it is possible to select an optimum pumping fluid resulting in an energy efficient system.

Contrary to this, in known stroker tools, the fluid used for moving the piston is often oil mud surrounding the tool. Not only is oil mud not an optimum pumping fluid, it has also been mixed with chemicals in order to turn the oil into mud for various purposes. Such chemicals may cause corrosion on the inner surface of the chamber. However, due to the fact that the force generator 4 of the present invention is a closed system, it is also possible to use a non-corrosive fluid.

The tool may also be provided with valves in connection with the pump. The valves are positioned so that one valve is placed in connection to each of the ducts in order to direct the fluid inside the duct. In this way, the pump is able to suck or pump the fluid in order to move the piston back and forth in the piston housing.

In another embodiment, the valves are positioned inside the pump in order to control the fluid direction, and in this way the movement of the piston.

Figure 3:
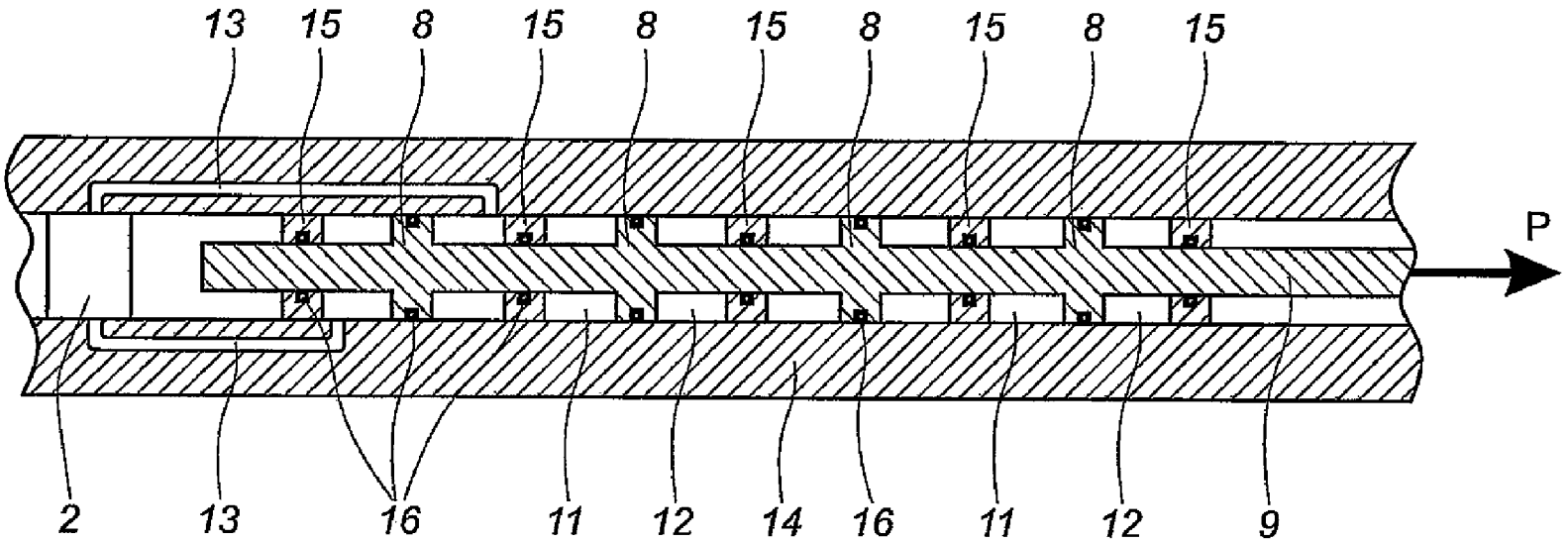
FIG. 3 shows a stroker tool having a plurality of axial force generators.

As shown in FIG. 3, in another embodiment, the stroker tool 1 may have several force generators 4 in order to provide more axial force P than what one force generator 4 can provide. As a general rule, four generators 4 can provide four times the axial force P of one force generator 4, and so forth.

In FIG. 3, the tube 14 is divided by five rings 15 into four piston housings 5. The shaft 9 penetrates all of the housings 5, and four pistons 8 are provided on the shaft 9 so that each piston 8 is provided in one of the four piston housings 5.

Each first 11 and second chamber 12 is fluidly connected to the pump 2 via a duct 13; however, only one set of ducts is shown in FIG. 3. The other ducts 13 connecting the pump 2 to each of the chambers 11, 12 are placed along the circumference of the tube 14, and are therefore not shown in FIG. 3.

Figure 4:
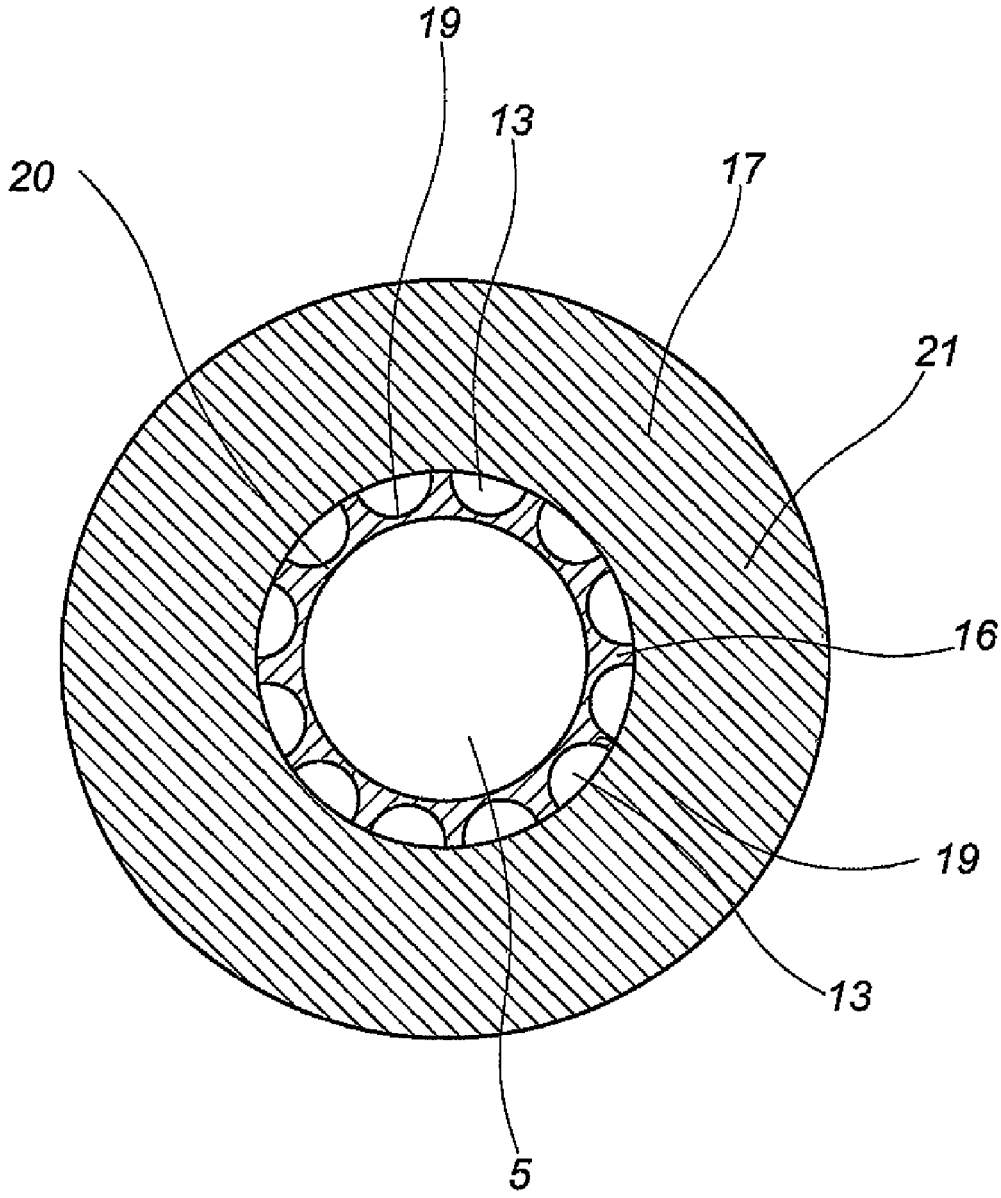
FIG. 4 shows a cross-sectional view of the stroker tool.

Six sets of ducts 13 can be seen in the cross-sectional view of FIG. 4. The twelve ducts 13 can be used to lead fluid 25 back and forth between six piston housings 5. In the embodiment of FIG. 1, in which the stroker tool 1 only has one force generator 4, the twelve ducts 13 are provided so that six ducts 13 allow a fluidly connection to the first chamber 11 and the other six ducts 13 allow a fluidly connection to the second chamber 12.

In another embodiment, four sets of ducts 13 are used to provide fluid 25 for four piston housings 5, and the last two sets of ducts 13 are used as extra fluid connections to the two piston housings 5 positioned rearmost from the pump 2 so as to compensate for the extra distance the fluid 25 has to travel in order to pump or suck fluid 25 into these two housings 5.

In this way, the stroker tool 1 can be provided with several ducts 13 which can be used in different ways in order to optimise the fluid connection from the chambers 11, 12 to the pump 2.

In another embodiment, the tool comprises valves in the transition between the ducts and the pump in order to allow any flow of fluid in a duct. In this way, the stroker tool can provide a varying axial force (P) in an axial direction of a downhole.

The embodiments described in the above with one, four, and six piston housings 5, respectively, are only to be seen as examples of the invention. Thus, a stroker tool 1 according to the invention may have a different number of piston housings 5 and a different number of ducts 13.

In FIG. 4, the tube 14 comprises an outer tube 17 and an inner tube 16. The outer tube 17 is constructed to withstand the pressure difference between the inside of the tube 14 and its surroundings in the well downhole. The wall 20 of the inner tube 16 is substantially thinner than the wall 21 of the outer tube 17. As can be seen, the outside of the inner tube 16 is provided with grooves 19 that define the ducts 13 when the inner tube 16 is positioned in the outer tube 17.

As mentioned above, the fluid system is a closed recirculation system, and the fluid 25 within the piston housing 5 recirculated by the pump 2 can thus be any kind of fluid, such as a fluid free of acid or the like. Therefore, the inner tube wall 20 can be made from a different metal than that of the outer tube wall 21, and it can thus be made of a metal which is not only stronger, but which may also be made very thin compared to the metal of the outer tube wall 21, since the inner wall 20 does not have to withstand the chemicals, such as acid or the like, in the surrounding fluid 25 in the well.

Furthermore, when the fluid 25 in the piston housing 5 is recirculated by the pump 2, one chamber 11, 12 functions as a fluid tank while fluid 25 is pumped into the other chamber 11, 12. In this way, no additional chamber is needed in the stroker tool 1, resulting in a stroker tool 1 taking up less space than known tools.

In addition, the fluid 25 in the stroker tool 1 does not have to be the fluid surrounding the tool 1 in the well, such as mud or acid-containing fluid. By recirculating a clean fluid 25 in the pump 2 and piston system, the individual parts in the pump 2 and the piston system are not subjected to the same wear as those of the known systems. Furthermore, the piston 8 within the housing 5 does not get stuck due to dirt in the fluid 25.

By having a thick outer tube wall 21, the tool 1 does not get stuck downhole if the ducts 13 break or the piston 8 is stuck within the housing 5. Known tools may bulge out due to a damage of the tool, and may thus get stuck downhole, a result of which may be that the well must be closed down. The stroker tool 1 according to the invention does not bulge out due an internal damage and can therefore always be brought up to above surface and repaired.

In the event that the stroker tool 1 is not submergible all the way into the casing 22, a downhole tractor can be used to push the stroker tool 1 all the way into position in the well. A downhole tractor is any kind of driving tool capable of pushing or pulling tools in a well downhole, such as a Well Tractor®.

The stroker tool 1 may be used in a stroker system where it is connected with another tool which uses the axial force P generated by the stroker tool 1. The other tool may be a penetration tool, such as a packer, or a perforation tool functioning like a hammer for penetration of e.g. the formation, or for releasing a stuck tool. The other tool may also be an expansion tool for pressing a mandrel into a casing 22 and expanding a cladding for sealing a leak in the casing 22. The axial force P provided by the stroker tool 1 may also be used for anchoring a tool in the casing 22 or for activating a safety release tool used in case a tool gets stuck downhole to release some parts of the tool from the rest of the tool.

The invention claimed is:

1. A stroker tool for providing an axial force in an axial direction of a downhole tool, comprising:

a pump, a driving unit for driving the pump, and an axial force generator comprising:

an elongated piston housing having a first and a second end, and a piston provided on a shaft, the shaft penetrating the housing for transmitting the axial force to another tool, wherein the piston is provided in the piston housing so that the shaft penetrates the piston and each end of the piston housing and divides the housing into a first and a second chamber, and wherein the first chamber is fluidly connected to the pump via a duct and the second chamber is fluidly connected to the pump via another duct so that the pump can pump fluid into one chamber by sucking fluid from the other chamber for moving the piston within the housing, and thereby moving the shaft back and forth.

2. The stroker tool according to claim 1, wherein the tool has valves in connection with the pump in order to control a direction of the fluid in each duct.

3. The stroker tool according to claim 1, wherein the tool has valves in connection with the pump in order to control a flow of the fluid in each duct.

4. The stroker tool according to claim 1, wherein the housing comprises a tube closed in each end by a ring within the tube, the rings having sealing means for providing a sealing connection to the shaft.

5. The stroker tool according to claim 4, wherein the tube has a plurality of ducts running from the first chamber to the pump and the same number of ducts running from the second chamber to the pump.

6. The stroker tool according to claim 4, wherein the tube comprises two tubes, namely an inner tube within an outer tube, and wherein the outside of the inner tube has grooves which, when placed within the outer tube, constitute the ducts.

7. The stroker tool according to claim 6, wherein the inner tube comprises a wall that is substantially thinner than a wall of the outer tube.

8. The stroker tool according to claim 1, wherein the piston is provided with sealing means for making a sealing connection between the piston and an inside of the housing.

9. The stroker tool according to claim 1, comprising a plurality of force generators.

10. The stroker tool according to claim 9, wherein the plurality of force generators is provided so that the tube comprises several rings dividing the tube into a number of piston housings where each housing is penetrated by the shaft on which, in each piston housing, a piston is provided and where a duct runs from each first and second chamber in each piston housing to the pump.

11. The stroker tool according to claim 1, wherein the duct connecting the first chamber and the pump is connected to the first chamber at an end closest to the pump, and the duct connecting the second chamber and the pump is connected to the second chamber at a rearmost end in relation to the pump.

12. The stroker tool according to claim 1, wherein the pump is a high pressure pump, such as a piston pump, a recirculation pump, a centrifugal pump, a jet pump, or the like pump.

13. The stroker tool according to claim 1, wherein the driving unit is a motor, such as an electrical motor.

14. A downhole system, comprising a stroker tool according to claim 1 and a tool, such as an expansion tool, a packer, a perforation tool, a release device, or the, using the axial force of the stroker tool.

* * * * *